United States Patent [19]

Vandergriff

[11] 4,153,976

[45] May 15, 1979

[54] ROLLER GIN WITH SPIRAL BLADE ROTOBAR

[76] Inventor: Arvel L. Vandergriff, 1701 Heffner St., Corcoran, Calif. 93212

[21] Appl. No.: 795,181

[22] Filed: May 9, 1977

[51] Int. Cl.[2] ..... D01B 1/06

[52] U.S. Cl. ..... 19/53

[58] Field of Search ..... 19/50–53, 19/54

[56] References Cited

U.S. PATENT DOCUMENTS

| | | | |
|---|---|---|---|
| 284,223 | 9/1883 | Osgood | 19/53 |
| 400,190 | 3/1889 | Chapin | 19/53 |
| 681,194 | 8/1901 | Chapin | 19/53 |
| 924,793 | 6/1909 | Kent | 19/53 |
| 2,929,111 | 3/1960 | Williams, Jr. et al. | 19/50 |
| 2,933,770 | 4/1960 | Jennings | 19/50 |
| 3,245,123 | 4/1966 | Brooks | 19/53 |
| 3,251,094 | 5/1966 | Vandergriff | 19/53 |

FOREIGN PATENT DOCUMENTS

| | | | |
|---|---|---|---|
| 27033 of | 1896 | United Kingdom | 19/53 |

*Primary Examiner*—Dorsey Newton

*Attorney, Agent, or Firm*—Mason, Fenwick & Lawrence

[57] ABSTRACT

A roller cotton gin including a ginning roller and a stationary knife to which seed cotton is conveyed by the friction surface of the ginning roller for separating lint fibers from the cotton seed, and a rotary stripping blade device adjacent the stationary knife having blades forming channel-like pockets therebetween for receiving the seed cotton deposited on the surface of the ginning roller and advanced to the zone of the stationary knife. The blades of the stripping blade device extend radially from a center shaft to span the width of the gin and are arranged in a one turn spiral path about the center shaft, and the stripping blade device has a diameter which is a small fraction of the ginning roller diameter and rotates at a speed causing the surface speed of the blade edges to be approximately the same as the surface speed of the ginning roller such as to restrain seeds in the channel-like pockets while the seeds are advanced over the edge of the stationary knife from the "pinch point" to a "release point" while the ginning roller strips lint from the restrained seeds and then releasing the seeds from blade restraint at the release point before they are pushed beyond the length of the fibers attached at the "pinch point" (after they travel about ½ the staple length beyond the knife edge) to return to the knife edge before the next blade applies advancing force to the seed and thereby withdraw substantially all the fibers from the seed. An auxiliary feed control roller for providing more even feed to the blade device and a comb structure to return unginned seeds to the ginning zone are also disclosed.

12 Claims, 7 Drawing Figures

ROLLER GIN WITH SPIRAL BLADE ROTOBAR

BACKGROUND AND OBJECTS OF THE INVENTION

The present invention relates in general to a cotton gin, and more particularly to a roller cotton gin constructed to strip lint from the seed of seed cotton with a high degree of efficiency and having high capacity.

The ginning of cotton, which is the operation in which the seeds are separated from the cotton fibers, is customarily carried out either in a saw gin or in a roller gin. The saw gin has been the dominant type for ginning the fuzzy seed Upland Cotton while the saw gin has not been acceptable for use on the Black Seed Cotton which generally has a longer staple. When ginning the extra long staple Black Seed Cottons, which are commonly referred to as a variation of Egyptian Cottons, on saw gins fiber breakage results in a shorter staple and generally a less desirable fiber for the high-quality products for which this fiber is normally used.

To generally distinguish between these two basic types of cotton, by far the most common type of cotton is the Upland Cotton which varies in staple length from less than $\frac{3}{4}$ inch to more than $1\frac{1}{8}$ inch. The seeds are fuzzy and each fiber is almost always saw ginned, although there are periodic efforts to roller gin the longer staple varieties to better preserve the fiber quality.

The other type of cotton is sometimes referred to as Black Seed Cotton, but more commonly referred to as extra long staple cotton. The staple length of this cotton varies widely as with the Upland Cotton but the more common varieties are about $1\frac{3}{8}$ inch to $1\frac{1}{2}$ inch in staple length. The fibers are very fine and silky and can be used in very expensive materials. Saw gins break and tangle these fine fibers which lowers their quality. Also, the fibers are so gently attached to the slick surface of the seed, the performance of the saw gin is not very satisfactory. For these reasons, this black seed cotton is almost always roller ginned.

A particular disadvantage has been encountered heretofore in connection with roller gins in that, whereas a saw gin produces fibers continuously, roller gins heretofore used are somewhat intermittent in operation. This occurs because of the fact that there is a reciprocating blade employed that cooperates with the ginning roller and a stationary doctor knife to strip the seeds from the fibers as the fibers are drawn past the doctor knife by the ginning roller. The reciprocation of the moving blade serves to interrupt the flow of cotton to the ginning roller so that in this type of roller gin, the productive rate of the roller gin has been relatively slow. The high quality of the fibers produced by a roller gin, however, have caused it to continue in use, particularly in regions where the cotton is characterized by particularly long fibers.

Various attempts have been made to improve the roller cotton gin and, in particular, to improve the gin with respect to the rate of fiber production in order to reduce the cost of ginning the Black Seed Cotton, while at the same time retaining the advantageous characteristics of the roller gin that the fibers produced are not entangled or broken.

Much effort has been given to alleviating difficulties with the length of time required in roller gins to pull the fibers from the seed, particularly long fibers, and to dislodge the seed from the fibers with the seeds in a relatively fiber-free condition, and do this continuously at a relatively high rate of speed. This has led to the construction of a roller gin having a ginning roller turning against a stationary knife so that the fibers will be drawn under the knife while the seeds are retained, and utilizing with this construction rotary or continuously moving knife means to knock the seeds away from the stationary knife. Difficulties have been encountered however in producing clean seeds with this construction because not enough ginning time was given to pull the fibers off the seeds and some considerable seed cracking occurred.

In the case of roller gins employing a reciprocating blade for the purpose of dislodging the seeds from the stationary knife, it has been proposed to have the moving blade overlap the stationary knife by about $\frac{1}{2}$ the length of the staple of the cotton being ginned. Fibers are pulled, by friction of the ginning roller, under the knife until the seed is against the knife edge. The friction is not always great enough to pull all the fibers from the seed, in which case it is necessary for the blade to push the seed away from the knife edge. In the case of the reciprocating blade, it operates parallel and close to the top surface of the blade to push the seed away. If the seed is not pushed beyond the length of most of the fibers, the friction on the fibers still held between the roller and the knife will draw the seed back to the knife, at which time most if not all the fibers are removed. It is difficult to determine accurately how many times an individual seed returns before all fibers are removed, as this depends on a number of variables, the most obvious one being the pressure of the ginning roller against the knife. The pressure can be enough for the friction to remove practically all the fibers as the seeds are pushed away by the blade. However, such pressure will usually cause the roll to overheat.

The overlap of the reciprocating blade of approximately one half the staple length has been accepted by those experienced in ginning extra long staple cottons for many years. The fact that the reciprocating blade completely blocks the access of the cotton to the ginning roller during its travel across the knife limits the capacity of such a method drastically. The economics of this method limits its use to the very longest staple of high quality whose value would be greatly reduced by saw ginning.

Literally hundreds of roller ginning machines have been designed in an effort to increase the capacity and thus reduce the cost of roller ginning. In spite of these efforts the reciprocating blade method prevailed through the 1950's. Subsequently, as a result of work by some engineers engaged in a program to improve methods of roller ginning at the U.S. Department of Agriculture's Ginning Laboratory at Mesilla Park, N.M., there appeared in about 1961 a roller gin design using square bars mounted on a driven chain system to travel over a knife, allowing the cotton to be fed to the ginning roller between the bars. This was called "the flight bar gin". Several companies manufactured and installed elaborate and expensive plants using the flight bar gin principle, but these plants were not successful, because it was not possible to maintain the required pressure on the flight bars as they moved over the knife, since sprocket and chain wear necessitated constant adjustment.

In analyzing the difficulties encountered with the flight bar gin and studying the art, I concluded that a rotating blade would serve the same purpose as the flight bar or the old reciprocating bar and permit attainment of improved roller ginning. Study of the art showed that rotating blades, such as blades on a rotating cylinder, had been previously tried and found to be unsuccessful, but the rotating cylinders with blades in those cases were approximately the diameter of the ginning roller which allowed for an overlap much greater than the staple length. I determined that many of the problems previously encountered with such large diameter rotating blades or with the flight bars should be alleviated by using a rotating blade about 2¾ inches in diameter and an overlap with the knife of about ¾ inch and a number of roller gins having this dimensional relationship and arrangement have been previously used for cottons having a staple length of, for example, about 1⅜ inch to 1½ inch.

I have devoted considerable study to investigation of the optimum diameter, speed and configuration of the rotating blade device and the overlap, particularly with regard to roller ginning of the shorter staple cotton. My studies indicate that for Upland Cotton the blade device should be about 2 inches in diameter to achieve optimum release of the seed after about ½ inch to ⅝ inch movement. In considering the configuration to maintain the required rigidity with such a small diameter blade and the number of blades to be provided, the R.P.M. is a factor. A study of the relationship of the surface speed of the rotating blade to that of the ginning roller indicates that the ratio should approach 1:1. If the ginning roller, as it approaches the ginning point, is fully covered with cotton, and the surface speed of the rotating blade is significantly less than that of the ginning roller, there would be intermittent build-ups of cotton ahead of the rotating blade as each blade comes into ginning position. These build-ups overload the ginning capacity of the ginning roller intermittently, resulting in the necessity to cut back the feed. The build-ups can be eliminated by setting up the surface speeds of the ginning roller and rotating blade to be close to the same speed.

With this established, the question of the number of blades on the rotating blade assembly can be determined within reasonable limits. As the seed is pushed away from the ginning point to the release position it must have time to return to the ginning point before the next blade moves to the ginning point. The travel of the ginning roller surface must be enough to pull the seed back to the knife before the next blade reaches the knife edge.

It has been determined that a rotating blade assembly in the range of 2 inches in diameter for Upland Cotton and in the range of 3 inches in diameter for extra long staple small seed cotton, and having four blade points or blade members more nearly meet this criteria. Of course, if more than four blades are used on the rotating blade assembly, the speed of the rotating blades has to be reduced or the speed of the ginning roller increased to avoid having the blade hit the seed before it returns to the knife edge, thus leaving lint on the seed.

It has been discovered, however, that a roller gin construction involving a rotatable blade assembly of such small diameter with straight blades, when the gin is operating at higher capacity, results in vibration, chattering and bumping of the rotobar forming the rotating blade assembly due to build-up of seed and fiber against the knife edges of the rotobar in the interval between the passing of the rotating blades over the knife edge, and having the straight edge strike them at the same instant along the length of the rotobar. This load is sufficient to cause the rotobar to flex, a condition which causes unginned seed locks to pass under the rotobar or rotating blade assembly with the seed.

This problem is eliminated by arranging the blades in a spiral fashion and forming them as radical blade members provided in a spiral groove on a cylindrical shaft, with the blades executing a spiral turn of one turn per length across the length of the blades on the rotating blade assembly. In one example, this may span a width of about 48½ inches, so that the spiral blades, four of which are provided, will execute one turn across the total length of the 48½ inches. It was found that with such a rotobar construction using spiral blades, the capacity can be increased to the extent that the cavities or channel-like pockets between the blades are sufficiently filled with unginned seed locks that the mass of seed lock in the pockets push the fibers down to the pinch point in a manner producing very advantageous operation.

When a few fibers from a seed lock or a group of seed locks are caught in the pinch point, between the knife edge and the ginning surface, adjacent and continuous fibers have enough attractive force to pull the entire group of fibers into the pinch point. A typical surface speed for the ginning roller is about 100 inches per second so the time element for the ginning of a single seed lock is very limited and of course conditions have to be ideal for the fibers to be caught in the pinch point as they move over it at this speed.

A spiral rotobar as described above, having a plurality of spiral blades executing one turn along the length of the blade portion of the rotobar, will permit the seed to be released by the blade after a travel of about ½ the staple length from the pinch point. One arrangement found to be satisfactory for extra long staple cotton is a ginning roller diameter of about 15 inches diameter, and a stationary knife blade mounted at approximately a tangent to the point of contact, and a rotating blade assembly of about 3 inch overall diameter located with its center line in the radial plane of the ginning roller which passes through the point of contact of the blade with the ginning roller, and with the blades clearing both the ginning roller surface and the blade by about 1/32 inch.

The spacing of the blades on the rotating shaft should be such that the peripheral speed of the rotating blade assembly is about the same as that of the ginning roller and, at the same time, permits the seed which still has fibers attached at the time of being released by the blade to be returned to the pinch point before being contacted by the next blade. The rotating blade assembly formed of the four spiral blades on the rotating shaft thus provides a plurality of channel-like pockets between the successive circumferentially spaced blades which are so correlated to the seed size and to the speed of rotation of the ginning roller and the rotating blade assembly as to cause the seed to be pushed away from the ginning point to a release position by engagement with the blade-like surface and then have time to return to the ginning point before the next blade-like surface moves to the ginning point.

It has been discovered that with such a small diameter rotating blade assembly or rotobar, it becomes difficult to obtain an even flow of cotton between the rotobar and the ginning roller. Obviously, if some of the cotton approaches the rotobar above the center line, it will be knocked back by the blades rather than being carried under the blade assembly to the zone of contact with the friction surface of the ginning roller. To alleviate this and achieve uniform feeding of the cotton to the ginning roller, a larger diameter auxiliary roller may be provided, spaced slightly upstream from the rotobar toward the discharge end of the feed chute, to press the cotton to the ginning roller and allow it to feed under the rotobar evenly.

An object of the present invention, therefore, is the provision of a novel roller gin construction having a rotating blade or rotobar device of small diameter and novel construction arranged immediately adjacent the working or leading end of the stationary knife, having an appropriate configuration and surface speed and spacing between blades to move the seed away from the knife edge and then allow it to return to the knife edge before the next blade hits the seed, and maintaining the surface speed relationship between the rotating blade assembly and the ginning roller so as to avoid an accumulation of unginned cotton on the ginning roller ahead of the rotating blade.

Another object of the present invention is the provision of a novel roller gin having a rotating blade device of small diameter relative to the diameter of the ginning roller having blades arranged in a spiral path spaced to define channel-like pockets therebetween so correlated to the seed size and to the speed of rotation of the ginning roller and the rotating blade device as to cause the seed to be pushed away from the pinch point of the working end of the stationary knife to the release point by engagement with the blade-like surfaces on the rotating blade device and then have time to return to the pinch point before the next blade-like surface moves to the pinch point, the release point being such that the seeds are not pushed out of the ginning zone with fibers still attached.

Yet another object of the present invention is the provision of a novel roller gin construction having a rotating blade device adjacent the edge of the stationary knife provided with plural blades transversely spanning the width of the gin and extending in a gentle spiral path, for example of about one turn, providing a blade device of small diameter compared to the diameter of the ginning roller having a surface speed close to the surface speed of the ginning roller, which prevents vibration, chattering or bumping of the rotating blade device when operating at higher capacity, arising from build-up of the seed and fiber against the knife edge in the interval between the passing of the rotating blades over the knife edge, and which substantially eliminates unginned seed locks being carried over with ginned seed.

Other objects, advantages and capabilities of the present invention will become apparent from the following detailed description, taken in conjunction with the accompanying drawings illustrating preferred embodiments of the invention.

DETAILED DESCRIPTION OF PREFERRED EMBODIMENTS

Figure 2:
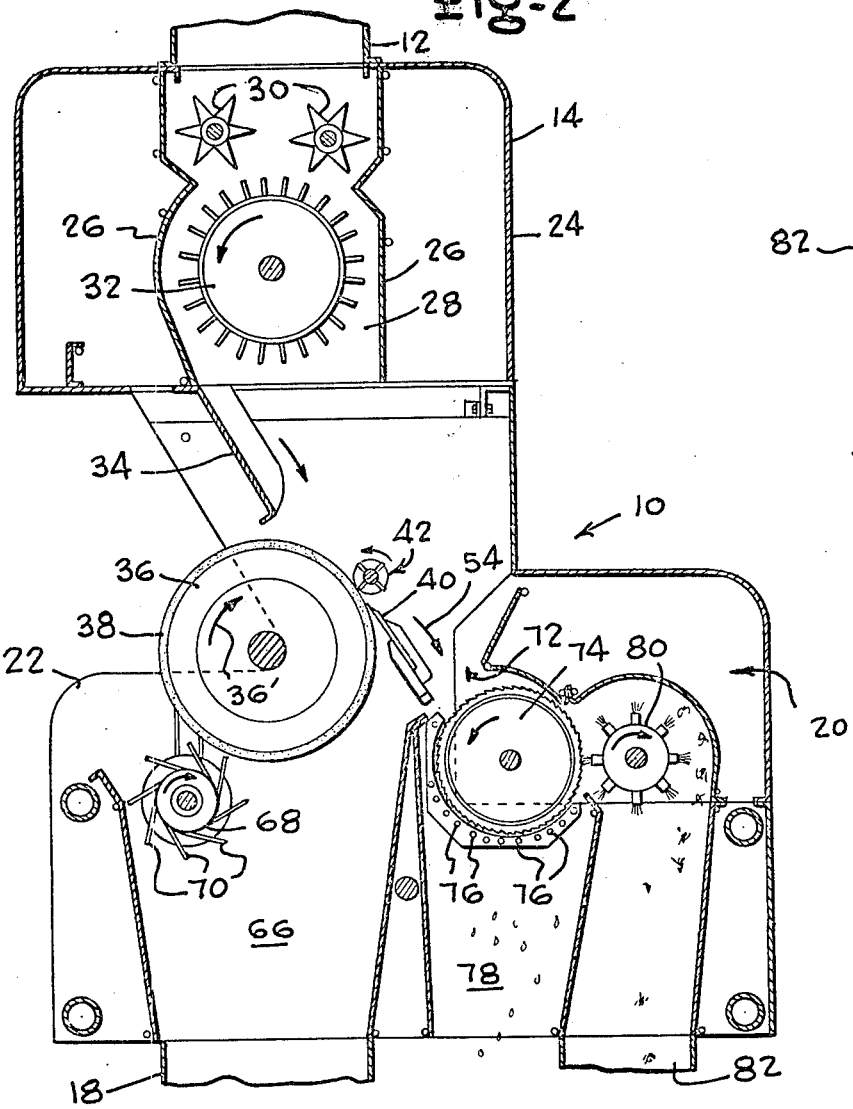
FIG. 2 is a vertical section view through the roller gin of the present invention, taken substantially along the longitudinal mid-plane of the gin.
Figure 1:
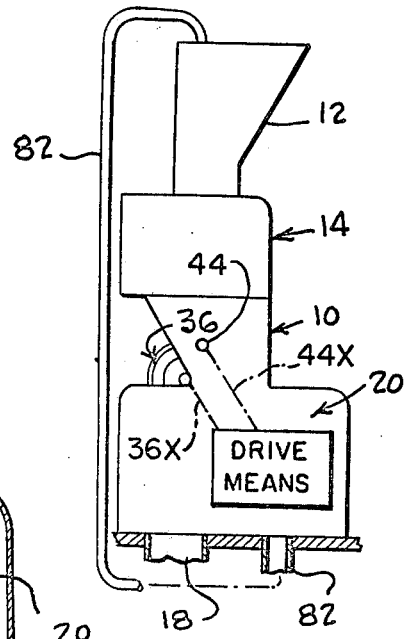
FIG. 1 is a diagrammatic elevational view of a roller cotton gin embodying the present invention.
Figure 6A:
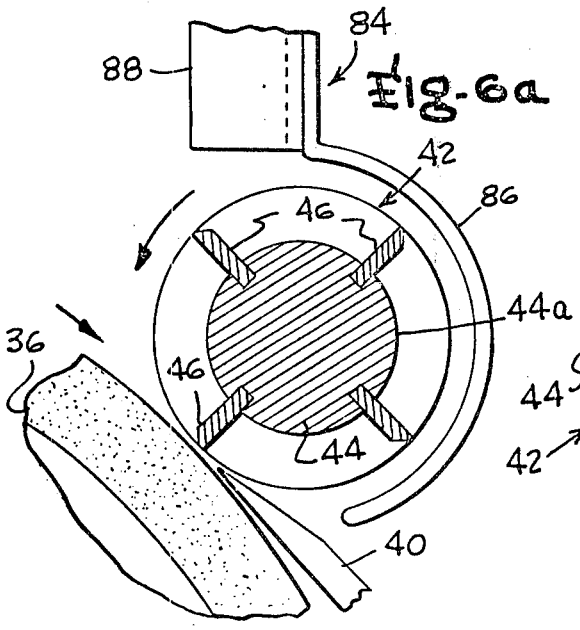
FIGS. 6*a* and 6*b* are fragmentary section and elevation views showing the spiral rotating blade device and associated stationary knife, adjacent a portion of the ginning roller, in another modified form having a comb device associated with the rotating blade device to permit passage of ginned seed but return unginned cotton to the ginning process.
Figure 6B:
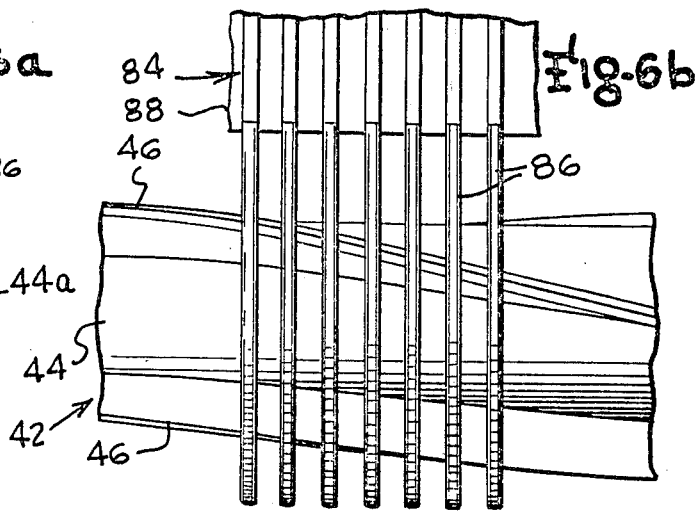
Figure 4:
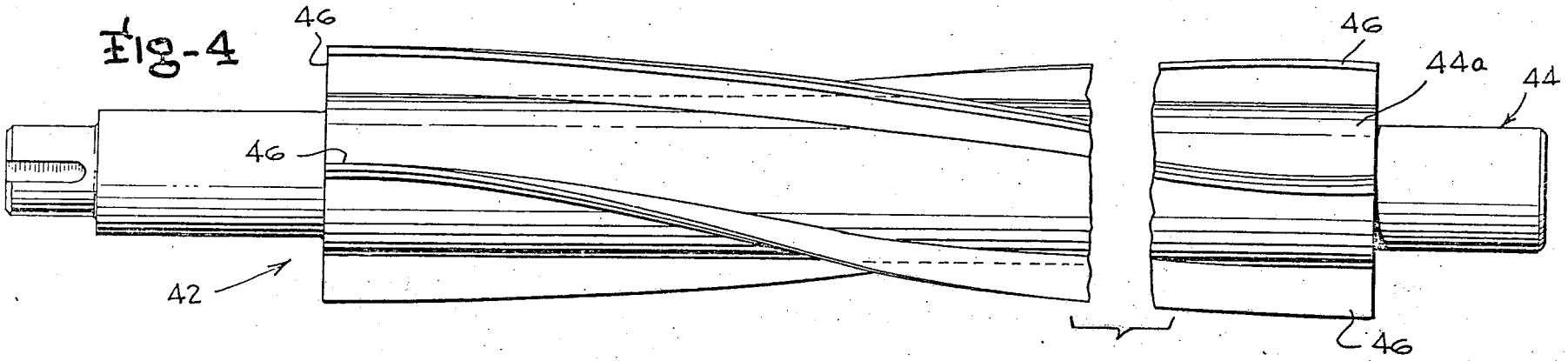
FIG. 4 is an elevation view of the spiral blade device used with the roller gin of the present invention.
Figure 3:
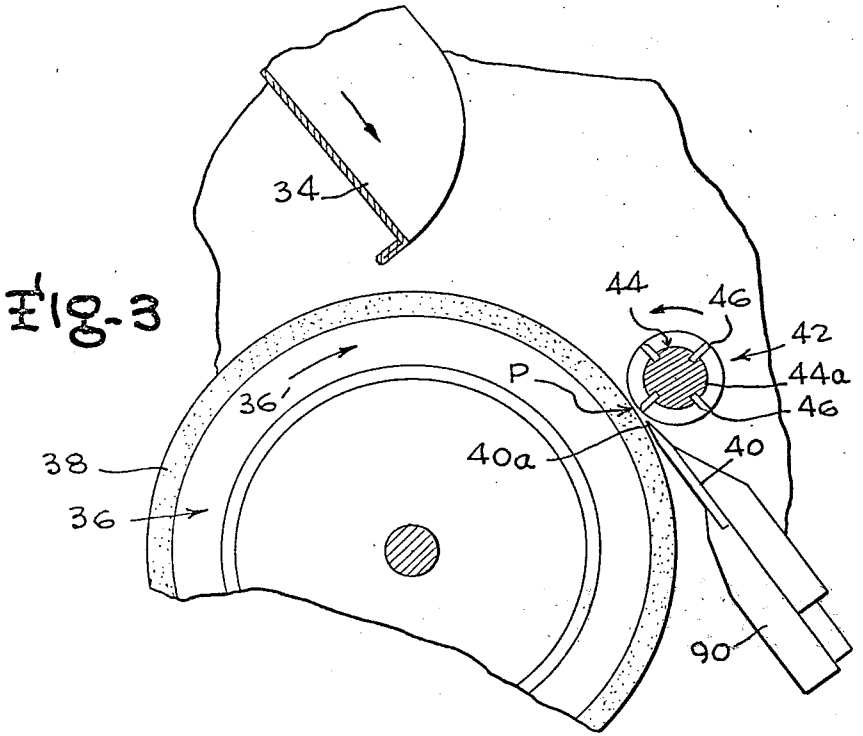
FIG. 3 is a fragmentary vertical section view, to enlarged scale, showing the spiral rotating blade device and the stationary knife and ginning roller portions of the gin.

Referring to the drawings, wherein like reference characters designate corresponding parts throughout the several figures, and particularly to the embodiments shown in FIGS. 1 to 4, the roller cotton gin of the present invention is indicated generally by the reference character 10, and in customary fashion, may be preceded by a distributor indicated generally at 12 in the diagrammatic elevational view of FIG. 1, with a feeder, indicated generally at 14, interposed between the distributor 12 and the roller cotton gin 10. The cotton to be ginned is fed into the machine by way of the feeder 14, in one suitable example, and the lint fibers that are separated from the seed are discharged into a lint duct or flue 18 for transporting the fibers to the subsequent processing station, such as a battery condenser, lint cleaner or other known lint processing equipment. The gin may be provided with any of a number of arrangements for reprocessing or reclaiming unginned locks. As one example, a comb or rib structure as shown in FIGS. 6*a*, 6*b*, and as hereinafter described may be provided to return unginned locks around the rotary blade device to the pinch point for reprocessing. As another example, there may be associated with the gin, as illustrated in FIGS. 1 and 2, a reclaiming station as indicated diagrammatically at 20, where the unginned seeds that may pass the ginning station are separated from the ginned seeds and conveyed by a suitable return duct back to the distributor or other suitable point in the plant.

The structure of the roller gin, and the associated feeder 14 and the optional reclaiming unit 18 is illustrated in the vertical section view of FIG. 2. The roller gin stand comprises, in accordance with usual practice, a frame 22, made up of sheet metal and suitable bracing members to support the various operating components of the gin and also provide support for the associated seed cotton feeder 14 which mounts on top of the frame 22. The seed cotton feeder 14 includes a housing 24, also typically formed of sheet metal and bracing members, having shaped interior sheet metal partitions 26 transversely spanning the width of the feeder and extending through the total height thereof defining a generally vertically arranged passage 28 for transfer of the seed cotton from the lower outlet of the feeder 14 to the gin stand. Movement of the seed cotton through the passage 28 of the feeder is controlled by a pair of feed rollers 30, which are usually driven by an automatically controlled variable drive mechanism, in accordance with conventional practice, in correlated relationship to the feed requirements of the gin, and transfer the cotton to the zone of action of the large feed wheel 32 delivering the seed cotton to the downwardly inclined slide 34 within the upper portion of the gin stand 10.

The cotton being delivered at a controlled rate from the lower discharge end of the feeder 14 and downwardly along the inclined slide or feed chute 34 is deposited by gravity onto the top of the ginning roller 36 which has a friction surface or cover 38 of leather or rubber-like material of such a nature that the fibers of the cotton tend to adhere thereto so that the cotton is carried around the ginning roller in the direction of the arrow 36' toward the stationary ginning knife 40. To cooperate with the ginning roller 36 and stationary ginning knife 40 in removing seed from the seed cotton, a rotating blade seed stripper member, which I refer to as a rotobar blade assembly 42 is provided immediately adjacent the leading or upstream edge 40*a* of the ginning knife, for example, with its center axis lying substantially in the radial plane extending from the center axis of the ginning roller 36 through the leading edge 40*a* of the ginning knife, and in the illustrated embodiment, is formed of a solid center shaft 44, having, for example, smaller diameter outer ends journaled in suitable bearings (not shown) in the side walls of the gin stand and having a cylindrical main shaft portion 44*a* extending therebetween substantially the full width of the gin stand carrying a plurality of spiral blades 46, four of which are shown in the illustrated embodiment, which extend along radial axes of the shaft portion 44*a* at any transverse section of the rotobar blade assembly 42 and extend along a helical path executing one turn per full length of the main shaft portion 44*a* with which each of the blades 46 is coextensive in length. In one illustrated example, the cylindrical main shaft portion 44*a* may have an axial length of about 48½ inches and a diameter of about 1 15/16 inch and have four spiral grooves cut therein about 7/32 inch deep and about ⅛ inch wide extending along respective helical paths executing one complete turn or revolution for the 48½ inch length of the main shaft portion 44*a*, with the grooves extending along a pair of diametric axes of the shaft portion 44*a* perpendicular to each other at each transverse section of the main shaft portion. The blades 46 may be formed of rectangular cross section bars having a thickness of about ⅛ inch and a width of ¾ inch, and having a 45° bevel at their outer edge, as shown, for a distance of 3/32 inch from the outer edge, the blades being preferably peened in place in the grooves provided therefor without welds.

Figure 5:
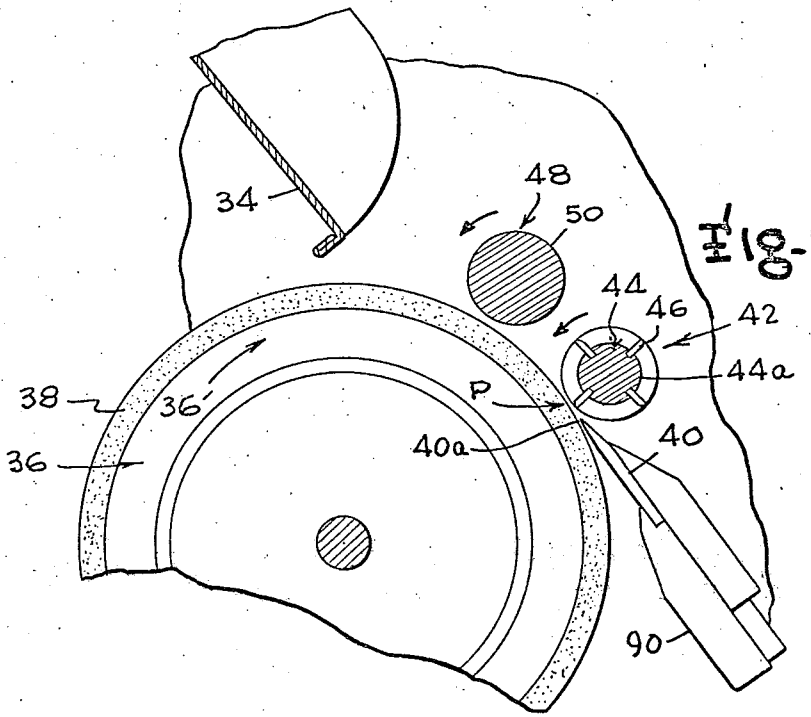
FIG. 5 is a fragmentary section view similar to FIG. 3, illustrating a modified form of roller gin embodying the present invention, having an auxiliary roller associated with the spiral rotating blade device.

I have found that the small diameter of the rotobar blade device sometimes causes an uneven flow of cotton between it and the ginning roller, where for example some of the cotton approaches the rotobar above its centerline. A smoother, more uniform feed of the seed cotton to the rotobar device and the knife can be attained by the arrangement of FIG. 5 where there is spaced slightly upstream from the rotobar blade assembly or stripper blade assembly 42 an auxiliary feed control roller 48 located between the rotobar blade assembly 42 and the discharge end of the slide or feed chute 34. The auxiliary feed control roller 48, as shown in FIG. 5, is formed of a cylindrical smooth surface roller member 50, having, for example, a diameter of 4 inches and reduced diameter ends journaled in bearings in the side walls of the frame 22 and positioned so that the cylindrical surface 52 passes very close to the surface of the ginning roller 36 during rotation of the auxiliary feed control roller 48. By suitable means known to those skilled in the art, such as pulleys and motor drive belts, not shown, the ginning roller 36, rotobar blade assembly or stripper blade assembly 42, and auxiliary feed control roller 48 are driven by drive means diagramatically indicated at 36X and 44X in FIG. 1, in the directions indicated by the arrows and at appropriate speed, as hereinafter discussed, to sweep the outer free edges of the spiral blades 46 of the rotobar 42 in the direction indicated by the arrow 42*a*, to move them inwardly toward the friction surface 38 of the ginning roller 36 and into the closest proximity to the surface 38 at the pinch point P just in advance of the leading or forward end of the stationary knife 40. The stationary ginning knife 40 bears on the friction surface 38 of the ginning roller 36 adjacent the rotobar blade assembly 42, and the fibers or lint of the cotton locks are drawn beneath the stationary ginning knife 40 while the seeds are prevented from passing beneath the knife because there is not sufficient clearance for the seeds. The fibers are thus pulled from the seeds by the friction surface 38 of the ginning roller as the ginning knife 40 restrains the seeds against movement and the seeds are discharged above the ginning knife in the direction of the arrow 54. The fibers or lint pulled under the ginning knife 40 by the friction surface of the ginning roller 36 pass into the outlet chamber 66 which communicates with the lint duct or lint flue 18, while those fibers which remain adhered to the friction surface 38 of the ginning roller 36 may be stripped therefrom, in accordance with conventional practice, by providing a doffing roller 68 having flexible rubber-like blades 70 which serve to strip the fibers from the friction surface 38.

In the event the reclaiming device indicated generally at 20 in FIG. 1 is associated with the roller gin, seeds that are discharged along the path indicated by the arrow 54 above the ginning knife 40, after the lint has been removed from them, pass down a seed chute 72 and are subjected to reclaiming processing by delivering them into the working zone of a rotary saw 74, for example, where the lint fibers still adhered to the seeds that have not been completely cleaned of lint are caught by the teeth of the saw and carried past stationary bars 76 through which the cleaned seeds pass and are removed through outlet passage 78. Seeds which still have sufficient lint on them to remain caught on the saw teeth are carried to the doffing zone where the doffing brush 80 removes them from the saw teeth and the incompletely ginned seeds with adhering lint fibers are then delivered by a return duct 82 back to the inlet side of the cleaner and extractor 12.

Alternatively, an arrangement such as that illustrated in FIGS. 6*a*, 6*b* may be provided, wherein, instead of providing the reclaiming mechanism involving the saw, cleaning bars, and doffing brush, a simple wire comb or rib-like structure 84 is provided adjacent the rotobar blade assembly 42, formed of a plurality of arcuately curved wire fingers 86 arranged in a concave, substantially cylindrical path facing toward and substantially concentric with the axis of the rotobar 42 and extending downwardly from a supporting block 88. The curved wire fingers 86 of the wire rib or comb structure 84 extend in parallel vertical planes perpendicular to the axis of the rotobar blade assembly 42 in the concentrically curving arcuate paths spaced just outwardly of but close to the free edges of the blades 46, spaced transversely apart a proper distance to permit passage of seeds therebetween but to return unginned cotton to the ginning process by causing them to be carried back across the top of the rotobar and down again to the pinch point P.

The ginning knife 40, as is customary, is rigidly mounted in the supporting frame 90 fixed in the housing of the gin stand, while the ginning roller may be movably supported so that it can be adjusted toward and away from the stationary knife 40 and be caused to engage the knife under varying degrees of pressure. The roller gin of the present invention operates to provide for highly efficient ginning of the long staple cotton because of the action of the rotobar or rotary blade assembly 42 with its spiral blades 46 and the stationary knife 40 and friction surfaced ginning roller 36, and the correlation of sizes and surface speeds thereof. It will be appreciated that the spiral blades 46 of the rotobar or rotary blade assembly 42 rotate in such a path that the outer tips or free edges of the blades describe a circular or cylindrical path whose diameter is a small fraction of the diameter of the ginning roller 36, and the blades define a series of pockets or channels of spiral configuration therebetween which receive the unginned seed cotton discharging from the feed chute 34 onto the upwardly facing surface portion of the ginning roller 36 and carried thereby into the zone of action of the rotobar or rotating blade assembly 42. Assuming a 15 inch diameter ginning roller 36 operating in the range of about 135 R.P.M., the rotobar surface speed should be about the same as the speed of the ginning roller, with rotobars in the size range of 2 inches in diameter for Upland Cotton, and 3 inches in diameter for extra long staple small seed cotton to provide the proper high capacity and effective ginning of the long staple cotton. As a specific example, the drive means for the 15" diameter ginning roller 36 and the rotobar, for example having a 3" diameter, may be chosen so as to drive these elements at such speed that the surface speed of the edges of the blades of the rotobar is less than but within about 90% of the surface speed of the ginning roller.

When the seed cotton enters the channels or pockets formed between the blades of the rotobar or rotary blade 42, and reaches the pinch point P, the fibers are drawn under the knife 40 by their adherence to the friction surface of the ginning roller 36 while the seed is restrained against movement thereunder by the working edge of the stationary knife. The diameter of the rotobar or rotary blade assembly 42 and its surface speed relative to the surface speed of the ginning roller are such that the seed carried through and beyond the pinch point while the fibers are being drawn therefrom beneath the knife 40 is released by the blade of the rotobar after a travel of about ½ the staple length from the pinch point, so that the seed is allowed to return to the knife edge before the next blade hits the seed. The travel of the ginning roller surface, of course, is enough to pull the seed back to the knife before the next blade reaches the knife edge, and thus the ginning roller and stationary knife coact to withdraw substantially all of the fibers from the seed so long as sufficient fibers remain attached to the seed to continue drawing the seed back to the pinch point after each release by the traveling blades. Tests of this construction have shown capacities which are much superior to any obtainable on prior roller gins, particularly where a reasonably low residual lint on the seed is maintained. For example, ginning with as low as 6.6 percent residual lint with a 4 blade rotobar producing 2 bales per hour have been attained, whereas about 12 percent residual lint occurs when the same cotton is ginned on a conventional saw gin.

What is claimed is:

1. A roller cotton gin comprising a ginning roller having a friction surface for conveying lint fibers to a pinch point station and a fixed knife for separating the lint fibers from cotton seed having a working edge pointing opposite to the direction of fiber travel substantially tangentially to and in near contact with the surface of said ginning roller providing a pinch point at said working edge, a rotary stripping blade device comprising a rotary shaft and a plurality of circumferentially spaced seed engaging continuous blades disposed in a one turn spiral path about the shaft spanning the width of said roller, the outer edges of the blades having a diameter which is a small fraction of the ginning roller diameter and moving through an arcuate cylindrical path downwardly toward, over and forwardly beyond said edge of the knife, the successive blades forming spiral shaped channel-like pockets therebetween for receiving the seed cotton therein and advancing the same over the knife edge forwardly, means for rotating the ginning roller at a predetermined surface speed, means for feeding seed cotton to the surface of the ginning roller at a location upstream of said knife edge adjacent the top of the ginning roller surface to advance the cotton down the downgoing side to the knife to cause the ginning roller to strip lint from seeds which are restrained by the knife edge and convey the stripped lint to a point of removal, and means for rotating said stripping blade device in a direction causing the blade edges approaching nearest the ginning roller surface to move in the same direction as the adjacent ginning roller surface portions and at a speed causing the surface speed of the blade edges to be approximately the same as the surface speed of said ginning roller such as to restrain seeds in said channel-like pockets while the seed advances over said knife edge from the pinch point toward a release point while the ginning roller strips lint from such restrained seeds and then release the seeds from blade restraint at said release point, the release point being spaced from the pinch point a distance such that any fiber still attached to any incompletely ginned seed is still sufficiently held between the knife and ginning roller to cause return of the incompletely ginned seed to the knife edge before the next blade applies advancing force to the seed, thereby to withdraw substantially all fibers from the seed so long as sufficient fibers remain attached to the seed to continue drawing the seed back to the pinch point after each release thereof, a driven auxiliary feed control roller located closely adjacent the surface of the ginning roller spaced a predetermined distance upstream from said stripping blade device between the latter and the region where the seed cotton is fed to the ginning roller surface to facilitate even flow of cotton between the stripping blade device and said surface and resist flow of seed cotton over the top of the stripping blade device.

2. A roller cotton gin as defined in claim 1, including a comb structure adjacent the stripping blade device for returning incompletely ginned cotton seeds to the pinch point for reprocessing comprising a rib-like comb spanning the blade portion of the blade device having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

3. A roller cotton gin as defined in claim 1, wherein said stripper blade device is formed with four blades spaced uniformly circumferentially on the shaft forming channels therebetween having a depth of about one-half inch, and the diameter of the cylindrical path traversed by the edge of the blades being about one-fifth the diameter of the ginning roller.

4. A roller cotton gin as defined in claim 1, wherein said stripper blade device is formed with four blades spaced uniformly circumferentially on the shaft forming channels therebetween having a depth of about one-half inch, and the diameter of the cylindrical path traversed by the edges of the blades being about three inches and the ginning roller having a diameter of about fifteen inches, and the means for rotating the blade device having means causing the surface speed of the edges of the blades to be less than out within about 90% of the surface speed of the ginning roller.

5. A roller cotton gin comprising a ginning roller having a friction surface for conveying lint fibers to a pinch point station and a fixed knife for separating the lint fibers from cotton seed having a working edge pointing opposite to the direction of fiber travel substantially tangentially to and in near contact with the surface of said ginning roller providing a pinch point at said working edge, a rotary stripping blade device comprising a rotary shaft and a plurality of circumferentially spaced seed engaging continuous blades disposed in a one turn spiral path about the shaft spanning the width of said roller, the outer edges of the blades having a diameter which is a small fraction of the ginning roller diameter and moving through an arcuate cylindrical path downwardly toward, over and forwardly beyond said edge of the knife, the successive blades forming spiral shaped channel-like pockets therebetween for receiving the seed cotton therein and advancing the same over the knife edge forwardly, means for rotating the ginning roller at a predetermined surface speed, means for feeding seed cotton to the surface of the ginning roller at a location upstream of said knife edge to cause the ginning roller to strip lint from seeds which are restrained by the knife edge and convey the stripped lint to a point of removal, and means for rotating said stripping blade device at a speed causing the surface speed of said blade edges to be approximately the same as the surface speed of said ginning roller such as to restrain seeds in said channel-like pockets while the seed advances over said knife edge from the pinch point toward a release point while the ginning roller strips lint from such restrained seeds and then release the seeds from blade restraint at said release point, the release point being spaced from the pinch point a distance such that any fiber still attached to any incompletely ginned seed is still sufficiently held between the knife and ginning roller to cause return of the incompletely ginned seed to the knife edge before the next blade applies advancing force to the seed, thereby to withdraw substantially all the fibers from the seed so long as sufficient fibers remain attached to the seed to continue drawing the seed back to the pinch point after each release thereof, and a driven auxiliary feed control roller located closely adjacent the surface of the ginning roller spaced a predetermined distance upstream from said stripping blade device between the latter and the region where the seed cotton is fed to the ginning roller surface to facilitate even flow of cotton between the stripping blade device and said surface and resist flow of seed cotton over the top of the stripping blade device.

6. A roller gin as defined in claim 5, wherein the cylindrical path traversed by the edges of said blades has a diameter about one-fifth the diameter of the ginning roller.

7. A roller gin as defined in claim 5, wherein said stripper blade device is formed with four blades spaced uniformly circumferentially on the shaft forming channels therebetween having a depth of about one-half inch, and the diameter of the cylindrical path traversed by the edge of the blades being about one-fifth the diameter of the ginning roller.

8. A roller cotton gin as defined in claim 7, including a comb structure adjacent the stripping blade device for returning incompletely ginned cotton seeds to the pinch point for reprocessing comprising a rib-like comb spanning the blade portion of the blade device having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

9. A roller gin as defined in claim 5, wherein said stripper blade device is formed with four blades spaced uniformly circumferentially on the shaft forming channels therebetween having a depth of about one-half inch, and the diameter of the cylindrical path traversed by the edges of the blades being about three inches and the ginning roller having a diameter of about fifteen inches.

10. A roller gin defined in claim 5, wherein said stripper blade device is formed with four blades spaced uniformly circumferentially on the shaft forming channels therebetween having a depth of about one-half inch, and the diameter of the cylindrical path traversed by the edges of the blades being about three inches and the ginning roller having a diameter of about fifteen inches, and the means for rotating the blade device having means causing the surface speed of the edges of the blades to be less than but within about 90% of the surface speed of the ginning roller.

11. A roller cotton gin as defined in claim 10, including a comb structure adjacent the stripping blade device for returning incompletely ginned cotton seeds to the pinch point for reprocessing comprising a rib-like comb spanning the blade portion of the blade device having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

12. A roller cotton gin as defined in claim 5, including a comb structure adjacent the stripping blade device for returning incompletely ginned cotton seeds to the pinch point for reprocessing comprising a rib-like comb spanning the blade portion of the blade device having plural substantially semi-circular curved wire fingers arranged in parallel vertical planes extending normal to the axis of said shaft, the wire fingers being located closely adjacent the path of the blade edges substantially concentric therewith and spaced transversely from each other a predetermined distance to pass seeds which have been stripped of lint therebetween but retain in the path of the blades unginned seeds to be returned by the blades to the pinch point.

* * * * *